US006814434B2

(12) United States Patent
Cho et al.

(10) Patent No.: US 6,814,434 B2
(45) Date of Patent: Nov. 9, 2004

(54) INK CARTRIDGE

(75) Inventors: Seo-hyun Cho, Suwon (KR); Myung-song Jung, Gunpo (KR); Young-su Lee, Suwon (KR); Hyung-hyu Hwang, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 3 days.

(21) Appl. No.: 10/460,257

(22) Filed: Jun. 13, 2003

(65) Prior Publication Data

US 2004/0041889 A1 Mar. 4, 2004

(30) Foreign Application Priority Data

Aug. 29, 2002 (KR) ..... 2002-51604

(51) Int. Cl.[7] ..... B41J 2/175
(52) U.S. Cl. ..... 347/86
(58) Field of Search ..... 347/85, 86, 87

(56) References Cited

U.S. PATENT DOCUMENTS 5,231,416 A * 7/1993 Terasawa et al. ..... 347/23
5,790,158 A * 8/1998 Shinada et al. ..... 347/86
5,856,838 A * 1/1999 Oda et al. ..... 347/85
6,467,890 B1 * 10/2002 Tajima et al. ..... 347/87

* cited by examiner

*Primary Examiner*—Thinh Nguyen
(74) *Attorney, Agent, or Firm*—Staas & Halsey LLP

(57) ABSTRACT

An ink cartridge includes a main body containing an ink absorbent body at an inside thereof and filled with ink, an ink head chip disposed at a lower portion of the main body to spray the ink onto a printing paper, an ink feeding pipe disposed at an inside of the lower portion of the main body to feed the ink in the main body to the ink head chip, and a pressure rib protruding from a bottom of the main body toward the ink absorbent body by a height higher than the ink feeding pipe to press the ink absorbent body contacting the pressure rib before coming in contact with the ink feeding pipe.

24 Claims, 2 Drawing Sheets

INK CARTRIDGE

CROSS-REFERENCE TO RELATED APPLICATIONS

This application claims the benefit of Korean Patent Application No. 2002-51604, filed Aug. 29, 2002, in the Korean Intellectual Property Office, the disclosure of which is incorporated herein by reference.

BACKGROUND OF THE INVENTION

1. Field of the Invention

The present invention relates to an ink cartridge, and more particularly, to an ink cartridge preventing air from flowing into a printing head chip before ink contained in the ink cartridge is used up.

2. Description of the Related Art

Generally, an ink cartridge for an inkjet printer includes a main body filled with ink. The ink in the main body is sprayed onto a paper by a predetermined amount at a time through an ink head chip provided to the main body.

FIG. 1 is a view showing the conventional ink cartridge disclosed in U.S. Pat. No. 4,771,295. Referring to FIG. 1, the conventional cartridge includes a main body 1 divided into three ink tanks. Each ink tank is provided with foam 2 made of a polyurethane material. The main body 1 is provided at a lower part thereof with an ink head chip 3 having ink spray nozzles 3*a*. Each ink tank inside the main body 1 is further provided at a bottom thereof with an ink pipe 4 having an ink chamber of a predetermined height in an upright position. Each ink pipe 4 is provided at an upper end thereof with a filter 5 filtering the ink to be supplied to the ink head chip 3. The ink pipe 4 and the filter 5 compress a lower portion of the foam 2 in an upward direction. Therefore, in a contact portion of the foam 2 with the ink pipe 4 and filter 5, capillary actions are increased. The foam 2 is compressed to increase density of a structure, thereby further preventing the air from moving toward the ink pipe 4.

However, the conventional ink cartridge with the above construction has to compress the lower portion of the foam 2 toward an upper end of the ink pipe 4, whereby a height of the ink pipe is increased. Thus, a distance between the foam 2 and the head chip 3 becomes longer. Therefore, a head loss (pressure loss) expressed by $-\rho gh$, wherein $\rho g$ is a specific weight, and h is the height of the ink pipe 4, occurs corresponding to the height of the ink pipe 4, and thus a negative pressure in the head chip 3 is decreased. Thus, ink sprays through the head chip 3 are not performed normally, causing a print quality degradation.

SUMMARY OF THE INVENTION

An aspect of the invention is to solve the above and/or other problems and to provide an improved ink cartridge of simple construction capable of blocking air from flowing into a head chip.

Additional aspects and advantages of the invention will be set forth in part in the description which follows and, in part, will be obvious from the description, or may be learned by practice of the invention.

Accordingly, an aspect of the present invention is to solve the foregoing and/or other problems by providing an ink cartridge including a main body having an ink absorbent body filled with ink, an ink head chip disposed at a lower portion of the main body to spray the ink onto a printing paper, an ink feeding pipe disposed at a lower portion inside the main body to feed the ink in the main body to the ink head chip, and a pressure rib protruding from a bottom of the main body to be higher than the ink feeding pipe to press the ink absorbent body which contacts the pressure rib before the ink feeding pipe comes in contact the ink absorbent body.

According to another aspect of the invention, the ink feeding pipe is disposed in a vertically upright position and is provided at an upper end with an ink filter.

Moreover, the main body includes a partition dividing an inside thereof into a foam chamber and an ink chamber and having a passage. The foam chamber includes the ink head chip disposed at a lower portion thereof and further includes the ink absorbent body, and the ink chamber communicates with the foam chamber through the passage and is filled with the ink.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
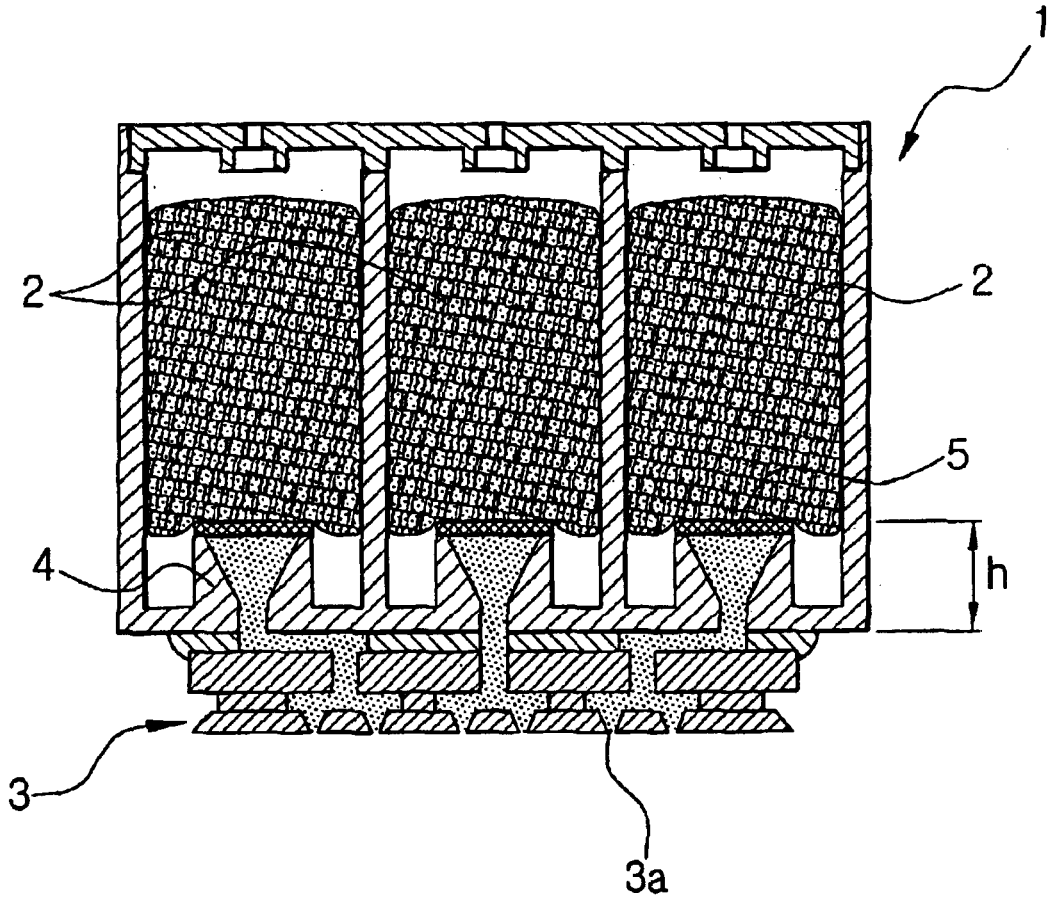
FIG. 1 (PRIOR ART)
FIG. 1 is a schematic cross-sectional view showing a conventional ink cartridge.

Reference will now be made in detail to the present preferred embodiment of the present invention, examples of which are illustrated in the accompanying drawings, wherein like reference numerals refer to the like elements throughout. The embodiment is described in order to explain the present invention by referring to the figures.

An ink cartridge according to an embodiment of the invention will be hereinafter described in detail with reference to the accompanying drawings.

Figure 2:
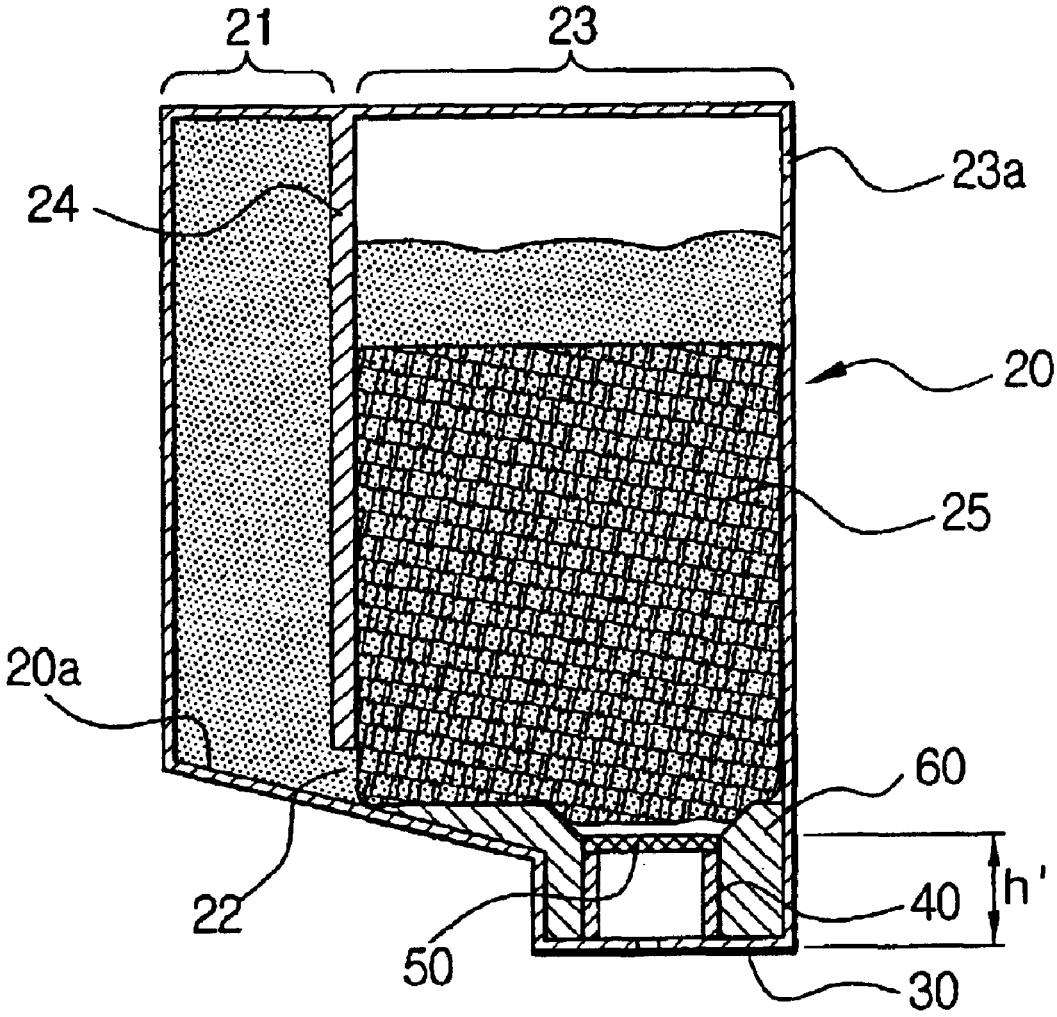
FIG. 2 is a schematic cross-sectional view showing an ink cartridge in accordance with an embodiment of the invention.

Referring to FIG. 2, the ink cartridge includes a main body 20 of which inside divided into an ink chamber 21 and a foam chamber 23 by a partition 24, a head chip 30 disposed at a lower portion of the foam chamber 23, an ink feeding pipe 40 feeding ink in the foam chamber 23 to the head chip 30, and a filter 50 disposed at an upper end of the feeding pipe 40 and a pressure rib 60.

The ink chamber 21 and the foam chamber 23 are filled with ink. The foam chamber 23 receives an ink absorbent body 25, such as a sponge, that is, a foam material. The foam chamber 23 is provided at an upper portion with an air vent 23*a* through which air flows into the foam chamber 23.

The partition 24 is disposed inside the main body 20 of the ink cartridge in a vertically upright position. The main body 20 is provided with a partition 22 having a passage 22 between a bottom 20*a* of the main body 20 and the partition 24. Through the passage 22, ink and air may flow between the ink and foam chambers 21 and 23.

The head chip 30 is disposed outside the lower portion of the foam chamber 23, and the ink feeding pipe 40 is disposed at a bottom inside the foam chamber 23.

The head chip 30 sprays the ink fed through the ink feeding pipe 40 onto a printing paper based on a predetermined input data for printing. To this end, the head chip 30 includes a spray nozzle and a printing circuit controlling a drive of the spray nozzle so that printing is performed by spraying on the printing paper a predetermined amount of the ink at a time according to the input data for printing.

The ink feeding pipe 40 is disposed at the bottom inside the foam chamber 23 in the vertically upright position with a predetermined height. The ink filter 50 is disposed at the upper end of the ink feeding pipe 40. The ink filter 50 blocks impurities and air by filtering the ink to be fed to the head chip 30 through the ink feeding pipe 40.

The pressure rib 60 protrudes from the bottom inside the foam chamber 23 higher than the ink feeding pipe 40. The pressure rib 60 comes in contact with the ink absorbent body 25 before the ink feeding pipe 40 does. The pressure rib 60 naturally protrudes higher than the ink filter 50. Therefore, a contact portion in a lower portion of the ink absorbent body 25 with an upper end of the pressure rib 60 is compressed so that capillary actions therein are increased.

With the above construction of the ink cartridge according to the embodiment of the invention, a height of the ink feeding pipe 40 can be shortened to decrease the distance between the ink absorbent body 25 and the head chip 30, thereby increasing a negative pressure.

That is, an ink feeding pipe is used to press a lower portion of a foam in the related art, thus, a height of the ink feeding pipe has to be high. However, according to the present invention, the pressure rib 60 is configured to be higher than the feeding pipe 40 to press the ink absorbent body 25, thereby obtaining the same capillary actions as in the related art. Consequently, the height of the ink feeding pipe can be lower than the related art. By lowering the height of the ink feeding pipe 40, a head loss, that is, a negative pressure loss of $-\rho gh'$ ($\rho g$ is a specific gravity, and $h'$ is the height of the ink feeding pipe) can be reduced. The lower portion of the ink absorbent body 25 is compressed by the pressure rib 60 and thus a density thereof is increased, whereby air is blocked from passing easily to the ink feeding pipe 40 and thus ink can be used stably.

As described above, with the ink cartridge according to the invention, the pressure rib 60 is configured to be higher around the ink filter and ink feeding pipe to press the lower portion of the ink absorbent body, whereby capillary actions occur in the ink absorbent body while the height of the ink feeding pipe is lowered to reduce the negative pressure loss due to the height of the ink feeding pipe.

Therefore, the negative pressure can be maintained to be high to feed ink stably through the ink feeding pipe and head chip, and a good quality of printed images can be obtained.

While the invention has been shown and described with reference to certain preferred embodiments thereof, it will be understood by those skilled in the art that various changes in form and details may be made therein without departing from the spirit and scope of the invention as defined by the appended claims and their equivalents.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art.

What is claimed is:

1. An ink cartridge comprising:

a main body containing an ink absorbent body and filled with ink;

an ink head chip disposed at an outside portion of the main body to spray the ink onto a printing paper;

an ink feeding pipe disposed at a lower portion of the main body to feed the ink in the main body to the ink head chip; and a pressure rib protruding from a bottom of the main body toward the ink absorbent body by a height higher than the ink feeding pipe to press the ink absorbent body to contact the pressure rib before coming in contact with the ink feeding pipe.

2. The ink cartridge according to claim 1, wherein the ink feeding pipe is disposed in an upright position with respect to the ink head chip and is provided at an upper end with an ink filter.

3. The ink cartridge according to claim 1, wherein the main body comprises a partition dividing an inside into a foam chamber and an ink chamber and having a passage through which the foam and ink chambers communicate with each other, the ink head chip is disposed on a lower portion of the foam chamber, the ink absorbent body is disposed inside the foam chamber, and the ink chamber is filled with ink.

4. An ink cartridge comprising:

a main body containing an ink absorbent body filled with ink, and having a bottom and a protrusion portion protruding from the bottom to an outside of the main body;

an ink head chip disposed at an outside portion of the protrusion portion to spray the ink onto a printing paper;

an ink feeding pipe disposed in the protrusion portion of the main body and between the ink head chip and the ink absorbent body to feed the ink in the main body to the ink head chip; and a pressure rib disposed between the bottom and the ink absorbent body to press a circumference portion of the ink absorbent body.

5. The ink cartridge according to claim 4, wherein the pressure rib does not contact an inner portion of the ink absorbent body corresponding to the ink feeding pipe to increase a capillary action of the ink contained in the ink absorbent body between the inner portion and the circumference portion.

6. The ink cartridge according to claim 5, wherein the circumference portion surrounds the inner portion of the ink absorbent body and corresponds to a bottom side of the ink absorbent body except the inner portion.

7. The ink cartridge according to claim 5, wherein the inner portion of the ink absorbent body is disposed in an inside of the pressure rib.

8. The ink cartridge according to claim 5, wherein the inner portion of the ink absorbent body protrudes from the circumference portion toward the ink head chip.

9. The ink cartridge according to claim 5, wherein the inner portion of the ink absorbent body is spaced-apart from a plane passing through the ink head chip by a first distance, and the circumference portion of the ink absorbent body is spaced-apart from the plane by a second distance greater than the first distance.

10. The ink cartridge according to claim 9, wherein the ink feeding pipe is disposed between the inner portion of the ink absorbent body and the ink head chip.

11. The ink cartridge according to claim 9, wherein the ink feeding pipe has a height in a direction perpendicular to the plane, and the height of the ink feeding pipe is less than the first distance.

12. The ink cartridge according to claim 11, wherein the pressure rib comprises:

a rib disposed between the ink feeding pipe and the protrusion portion of the main body and having a second height greater than the height of the ink feeding pipe.

13. The ink cartridge according to claim 9, wherein the main body comprises a partition dividing an inside of the main body into an ink chamber and a foam chamber containing the ink absorbent body, and forming a passage with the bottom of the main body, and the passage is spaced-apart from the plane by a third distance equal to or greater than the second distance.

14. The ink cartridge according to claim 13, wherein the bottom of the main body is inclined with respect to the plane.

15. The ink cartridge according to claim 13, wherein the bottom of the main body is inclined in a direction from the passage toward the ink feeding pipe.

16. The ink cartridge according to claim 13, wherein the bottom of the main body comprises a first portion forming the passage with the partition and a second portion disposed adjacent to the ink feeding pipe, and the first portion is spaced-apart from the plane more than the second portion.

17. The ink cartridge according to claim 16, wherein the bottom of the main body comprises a third portion is disposed in the ink chamber, the first and second portions of the bottom of the main body is disposed in the foam chamber, and the third portion is spaced-apart from the plane more than the first and second portions.

18. The ink cartridge according to claim 17, wherein the third, second, and first portions of the bottom of the main body are disposed on a second plane inclined with respect to the plane.

19. The ink cartridge according to claim 13, wherein the pressure rib comprises:

a first rib disposed adjacent to the passage and having a first thickness; and a second rib disposed adjacent to the ink feeding pipe and having a second thickness thicker than the first rib.

20. The ink cartridge according to claim 13, wherein the pressure rib comprises:

a thickness varying according to a distance from the passage toward the ink feeding pipe.

21. The ink cartridge according to claim 13, wherein the pressure rib comprises:

a first rib surface corresponding to the bottom; and a second rib surface corresponding to the circumference portion of the ink absorbent body.

22. The ink cartridge according to claim 21, wherein the first rib surface of the pressure rib is inclined with respect to the plane.

23. The ink cartridge according to claim 21, wherein the second rib surface of the pressure rib is parallel to the plane.

24. The ink cartridge according to claim 21, wherein the circumference portion of the ink absorbent body is parallel to the plane.

* * * * *